United States Patent [19]

Humble et al.

[11] Patent Number: 4,676,343

[45] Date of Patent: Jun. 30, 1987

[54] SELF-SERVICE DISTRIBUTION SYSTEM

[75] Inventors: David R. Humble, Deerfield Beach; David L. Gentzler, Boynton Beach; Steven J. Tilidetzke, Coconut Creek, all of Fla.

[73] Assignee: CheckRobot Inc., Deerfield Beach, Fla.

[21] Appl. No.: 628,913

[22] Filed: Jul. 9, 1984

[51] Int. Cl.[4] ..... G07C 11/00

[52] U.S. Cl. ..... 186/61; 177/50; 235/383; 235/437; 340/572; 364/478

[58] Field of Search ..... 186/55, 59, 61, 62, 186/68, 69; 235/383, 385, 437, 379, 380, 382; 340/825.31, 825.35, 551, 552, 572; 198/504, 505; 364/478, 403, 567; 177/150; 209/534, 925

[56] References Cited

U.S. PATENT DOCUMENTS

| | | | |
|---|---|---|---|
| 2,746,679 | 5/1956 | Stratton et al. | 235/383 |
| 2,919,851 | 1/1960 | Otis | 235/383 |
| 3,111,576 | 11/1963 | Lipschutz | 186/61 X |
| 3,436,968 | 4/1969 | Unger et al. | 364/567 X |
| 3,538,311 | 11/1970 | Weidmann | 235/383 |
| 3,541,309 | 11/1970 | Cutter | 235/383 |
| 3,589,514 | 6/1971 | Townsend | 250/557 X |
| 3,681,570 | 8/1972 | Abt | 235/383 |
| 3,681,571 | 8/1972 | Strohschneider | 235/383 |
| 3,690,411 | 9/1972 | Potrafke | 186/68 |
| 3,749,191 | 7/1973 | Ashen et al. | 177/50 X |
| 3,818,191 | 6/1974 | Fennema et al. | 235/437 |
| 3,819,012 | 6/1974 | Beck, Jr. et al. | 186/61 |
| 3,836,755 | 9/1974 | Ehrat | 186/61 X |
| 3,990,540 | 11/1976 | Aleshire et al. | 186/61 |
| 4,071,740 | 1/1978 | Gogulski | 186/61 X |
| 4,108,363 | 8/1978 | Susumu | 235/383 |
| 4,141,078 | 2/1979 | Bridges, Jr. et al. | 340/572 X |
| 4,392,553 | 7/1983 | Foster | 186/68 X |
| 4,394,645 | 7/1983 | Humble et al. | 340/572 |
| 4,482,058 | 11/1984 | Steiner | 209/534 |
| 4,540,106 | 9/1985 | Fukatsu | 235/379 X |
| 4,583,083 | 4/1986 | Bogasky | 186/52 X |

*Primary Examiner*—Joseph J. Rolla
*Assistant Examiner*—Kevin P. Shaver
*Attorney, Agent, or Firm*—Robin, Blecker & Daley

[57] ABSTRACT

The check-out counters for use in a supermarket, or the like, are provided with a laser scanner for reading the UPC labels on the individual products presented to it by each customer. The counters are also provided with transport belts or conveyors controlled by a central processor which, in turn, is supplied with information from a weigh scale under the input conveyor and from optical curtain devics at strategic locations along the belts and in a bagging area. The outfeed conveyor operates through a tunnel such that a customer cannot reach a product being conveyed therethrough. An opticl curtain disposed at the entry to the tunnel is broken by passage of an article into the tunnel and also by a customer reaching into the tunnel. Products are conveyed to the bagging area if (1) the actual weight of the product as determined by the scale corresponds to the anticipated weight obtained from a memory bank based upon the product UPC label identification and (2) none of various other events have occurred. A display screen prompts the customer with questions and instructions. Improper use of system causes interruption or reversal of conveyor operation with requirement that product be removed and re-scanned. When scanning is complete, customer activates an input signal and is furnished with a printed itemized list which is taken along with subsequently bagged products to a cashier for payment and issuance of a final receipt. An article surveillance sysem may be included to detect any tagged products transported along the pedestrian path rather than around the path through the tunnel.

32 Claims, 11 Drawing Figures

FIG. 7.

HELLO: THIS IS A TOUCH-ACTIVATED DISPLAY
SIMPLY TOUCH THE DESIRED SQUARE OF THE
SCREEN TO MAKE YOUR SELECTION

I'M READY TO BEGIN SCANNING 27

I NEED TO REVIEW THE OPERATING
INSTRUCTIONS BEFORE BEGINNING 28

HELP! I WOULD LIKE ASSISTANCE 29

FIG. 8.

| ITEM | PRICE |
|---|---|
| MAMAT RICE | .55 |
| GARL DRESS | .41 |
| GREEN BEAN | .34 |
| KEN-L-RATN | 6.95 |
| 10LB HAM | 11.75 |
| SUBTOTAL | $ 20.00 |

IF YOU HAVE FINISHED SCANNING YOUR
GROCERIES, TOUCH THIS SQUARE, 30
IF NOT, CONTINUE SCANNING.

FIG. 9.

THANK YOU
FOR SHOPPING AT
SUPERMARKET

PLEASE TAKE YOUR RECEIPT AND
PROCEED TO THE CASHIER WHO
WILL HANDLE YOUR COUPONS

PLEASE DO NOT FORGET TO TAKE YOUR CART

FIG. 10.

PLEASE REMOVE THE LAST ITEM
FROM THE CONVEYOR BELT

IT HAS NOT BEEN SCANNED
AND/OR REGISTERED PROPERLY
AND MUST BE SCANNED AGAIN

HELP! I WOULD LIKE ASSISTANCE.

47

SELF-SERVICE DISTRIBUTION SYSTEM

BACKGROUND OF THE INVENTION

The present invention relates to a self-service distribution system for use with articles bearing individual media that contain identification data recorded in machine readable form, and, more particularly, to automatic check-out equipment for use in supermarkets or the like.

In U.S. Pat. No. 3,836,755 for "Self-Service Shop", there is disclosed, as summarized in its abstract, equipment for a self-service shop having a check-out station for determining sales data from machine readable data relating to the type of article and its weight that has been applied to articles purchased by a customer, the equipment comprising a container in which the customer places the articles that he wishes to purchase, the container including means for reading the data applied to each article as it is placed in or removed from the container, and weighing means for indicating the increase and decrease in weight of the container resulting from placing or removing an article therein. The equipment also includes a system for evaluating the data read by the reading means and the weight indication to determine whether the purchased article has been put in or removed from the container and the data correctly read, a signaling system being provided to indicate if either the article data has been correctly read but the article has not been put in or removed from the container or the correct weight has been indicated but the data has not been correctly read. The evaluation system may be in the container or in the check-out station in which case communication between it and the container is by radio.

Unfortunately, the system described in the U.S. Pat. No. 3,836,755 is impractical. In order that an establishment can recoup its capital investment in automatic check-out equipment it is essential that it be used in a high volume situation. But, the patented system requires each customer to have an individual data reading and article weighing cart. This means that a large supermarket, for example, might require 50 to 100 or more such carts. Also, because many products in a market are large in size, the carts must be generously dimensioned to accommodate all the products a customer might elect to purchase during a single market visit. However, unlike the conventional nestable welded wire shopping cart, the cart in the aforesaid patent can not be nested, and this creates a major storage problem when not in use.

A somewhat different approach in a different environment is found in U.S. Pat. No. 4,141,078 for a "Library Circulation Control System." As summarized in the abstract of this patent, there is provided an automated library circulation control system which includes a plurality of remote book processing terminals, and a computer controlling the terminals and processing data between the terminals and the computer to maintain a current inventory of the circulation status of the library books. The system provides for automatic charging of library materials by patrons, record keeping of all library transactions, modification and interrogation of computer data files, intercommunication between the computer and a remote data processor and detection of unauthorized removal of books from the library. Each terminal has a card reader for patron identification, an optical reader for book identification, an electromagnetic activator for magnetizing and demagnetizing a magnetic strip in each book, a printer for printing charge-out information, and a display screen and keyboard for communication between patron and computer. In charging a book, a patron inserts his card in the card reader and places the book in a book tray in the terminal. The optical scanner reads bar coded symbols on a label on the front of the book. The computer compares the card reader and optical scanner input with its data files to determine that the patron is authorized to charge-out books and that the book is authorized to be checked out. If authorization is given, the transaction is recorded by the computer which then enables the printer to provide a print-out of the transaction for the patron.

The U.S. Pat. No. 4,141,078 system is uniquely adapted to library usage but is not applicable to supermarket operation for reasons that should be readily apparent. It is, therefore, an object of the present invention to provide a self-service distribution system that is admirably suited for use in a supermarket or similar distribution environment.

Another object is to provide such system with adequate safeguards against misuse either inadvertently or through deliberate action.

A further object is to make such system sufficiently economical to install that its use is economically desirable.

SUMMARY OF THE INVENTION

In accordance with the present invention there is provided a self-service distribution system for use with articles bearing individual media that contain identification data recorded in machine readable form, said system comprising in combination: a check-out station; and a controlled pedestrian pathway; said check-out station comprising means for reading said media on articles presented thereto by an individual, means for conveying said articles out of the reach and control of said individual to a pick-up point, means for cross-checking a physical parameter of each article that is being conveyed with the identification data for said article that has been read and verifying the identity of said article that is being conveyed, means for returning to said individual any article that fails said verification, and means for use in establishing that said individual is entitled to remove said presented articles from the distribution area.

In preferred version, the invention embodies such out-of-reach conveying means in part as a conveyor extending into a tunnel, thus providing a security zone. The entry to the security zone is equipped with a monitoring device, such as a light curtain extending across the security zone entry. A processor, which effects such article parameter verification, also looks to the occurrence of various other events, discussed below, and is operative to move the conveyor in article acceptance or article rejection senses in response both to the article parameter cross-check and the occurrence of any of such various other events. The pedestrian passageway may be controlled by a surveillance system, but same is optional.

BRIEF DESCRIPTION OF THE DRAWINGS

The invention will be better understood after reading the following detailed description of the presently preferred embodiments thereof with reference to the appended drawings in which:

FIG. 7 is an illustration of the legends appearing on a display screen for communicating with customers using the embodiment of FIG. 1;

FIG. 8 is another display screen applicable to both the FIG. 1 and FIG. 5 embodiments of the invention;

FIG. 9 is a further display screen applicable to both embodiments of the invention;

FIG. 10 is a further display screen applicable to both embodiments of the invention.

The same reference numerals are used throughout the drawings to designate the same or similar parts.

DETAILED DESCRIPTION OF THE PREFERRED EMBODIMENTS

Figure 1:
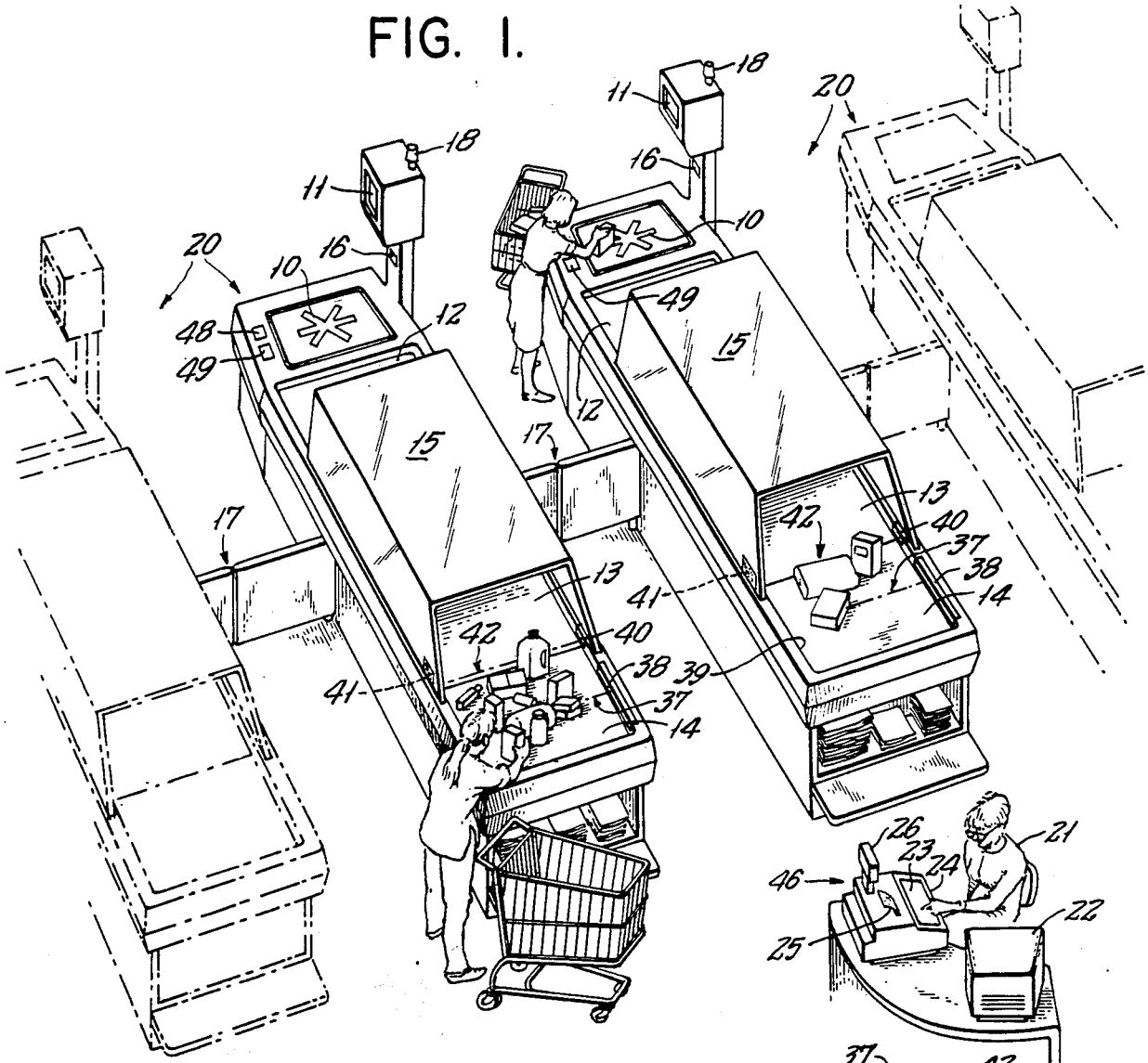
FIG. 1 is a perspective view of a plurality of single lane check-out stations illustrating one embodiment of the present invention.

Referring to FIG. 1, there is shown a representative section of the check-out area in a supermarket wherein the counters and intervening passageways are constructed in accordance with one embodiment of the present invention. Each counter, designated generally by the reference numeral 20, has a laser universal product code reader 10, a display screen 11 for interactive customer communication, an entry conveyor 12, an outfeed conveyor 13, a bagging area 14, a tunnel 15, a receipt unit 16 (best seen in FIG. 2), passageway control gates 17, and an assistance signal lamp 18.

Figure 3:
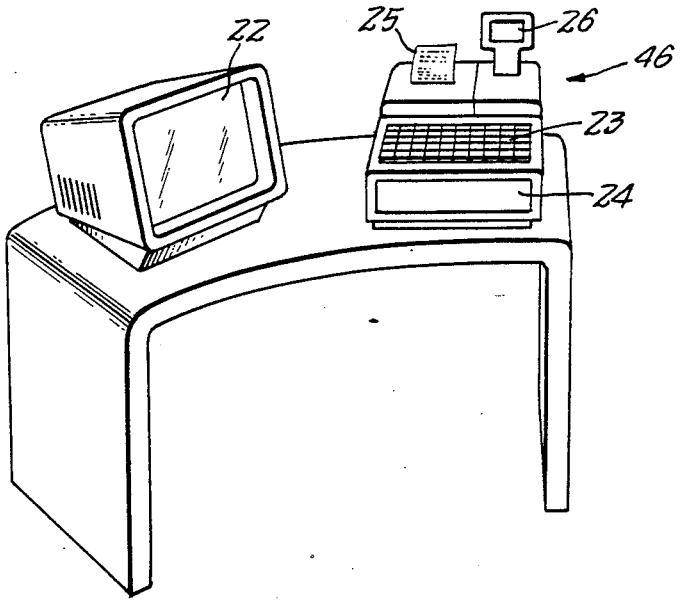
FIG. 3 is a front perspective view of the cashier station forming a part of the embodiment illustrated in FIG. 1.

For each group of check-out counters, a group can consist of two or more counters, there is provided a single cashier 21, best seen in FIG. 1, who is furnished with a master monitor screen 22, a keyboard 23 with cash drawer 24, a final sales slip printer 25, and a customer viewable display 26. The details of the cashier position are best seen in FIG. 3.

Most products in a supermarket are provided with identification in the form of the universal product code (UPC) which identifies the product as well as one of its parameters such as size, volume or weight. Size and volume can each be converted by known means into corresponding weight. Thus, reading the UPC label on the product can furnish information as to weight of any product.

In using a check-out counter 20, a customer approaches a counter with items to be purchased, usually transported to this point in a conventional shopping cart. If the counter is available for use, the display screen 11 will carry the messages shown in FIG. 7. As stated in the initial message, the display screen 11 is touch sensitive or touch activated by touching with a human digit at any one of a number of predetermined locations. For the particular example illustrated in FIG. 7, there are three sensitive locations 27, 28 and 29. Applying a finger to one of the locations is equivalent to operating a switch or pressing a signal button, or the like, and communicates to a central processing unit the affirmative response to the associated inquiry displayed on screen 11. For this initial discussion of the system usage it will be assumed that the customer is experienced and will touch location 27. A complete explanation of what occurs will be provided later. For the present, it is sufficient if we assume that the laser reader 10 is activated.

The customer now passes each item, one by one, UPC code down, over the laser and deposits it on the entry conveyor 12. Assuming no problems, the prices and item identifications will appear on the display as shown in the example illustration of FIG. 8, as the items are transported by the conveyors through the tunnel 15 out of reach of the customer to the bagging area 14.

When all items have been scanned over laser 10 and placed on entry conveyor 12, the customer will touch the touch sensitive input location 30 identified in the display of FIG. 8. This initiates the presentation to the customer of a printed receipt from the receipt unit 16 and changes the display on screen 11 to that shown in FIG. 9.

The customer takes the receipt and the shopping cart and proceeds through the control gates 17 to the bagging area 14 to bag the items, place the loaded bags in the shopping cart, and then proceed to the cashier 21. Each counter 20 will have a separate, identifier, a number, a letter, a combination, or the like by which it can be identified to the cashier 21. This identifier will appear on the printed receipt proffered to the cashier, and it will also appear on the master monitor screen 22 along with the subtotal corresponding to that printed by the receipt unit 16 and temporarily stored in a central processing unit (CPU).

Through the keyboard 23 the cashier can enter credit for any proffered coupons and can add any items that could not be handled automatically by the counter 20. These might be oversize items- or an item without a UPC label, for example. As the cashier makes entries via keyboard 23, a visual confirmation is provided to the customer by display 26. A final receipt is printed and furnished by printer 25, and the payment transaction is accomplished in the conventional manner.

For a self-service system to be effective it must include various safeguards to accommodate inadvertent customer mistakes and to separate customers and prevent commingling the articles from one customer with those of another. The system must also insure against attempts to either bypass the system or defraud. For this purpose there are provided a series of electronic curtains or photoelectric devices and an article surveillance system.

Figure 2:
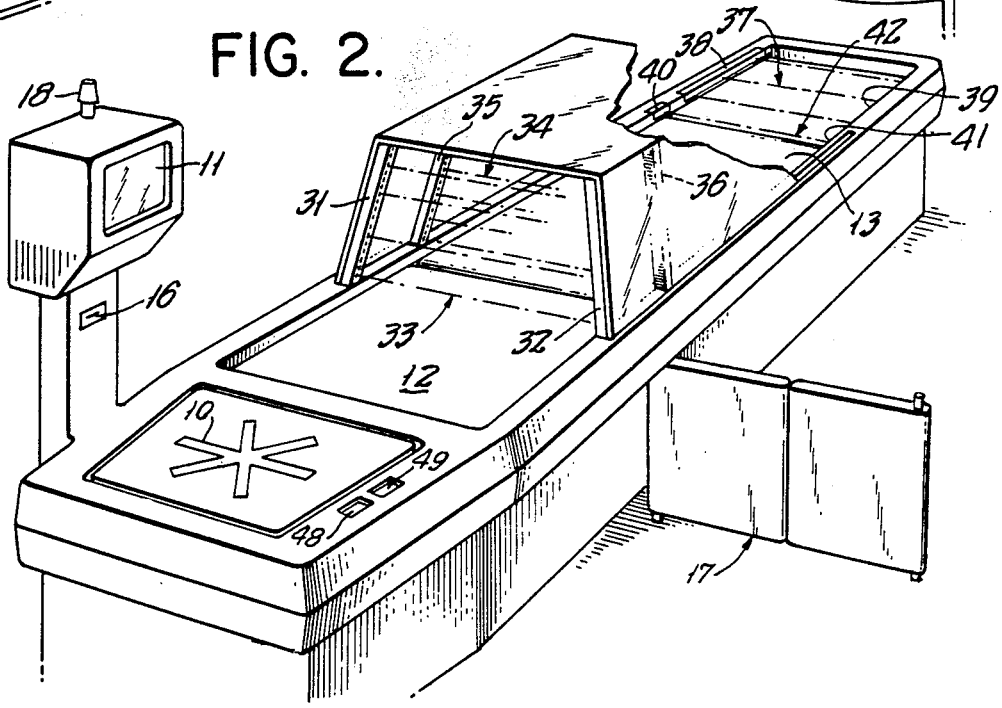
FIG. 2 is a perspective view of one of the check-out stations or counters as used in the embodiment of FIG. 1, but seen from the point of customer entry while the illustration in FIG. 1 is seen from the point of customer egress.
Figure 4:
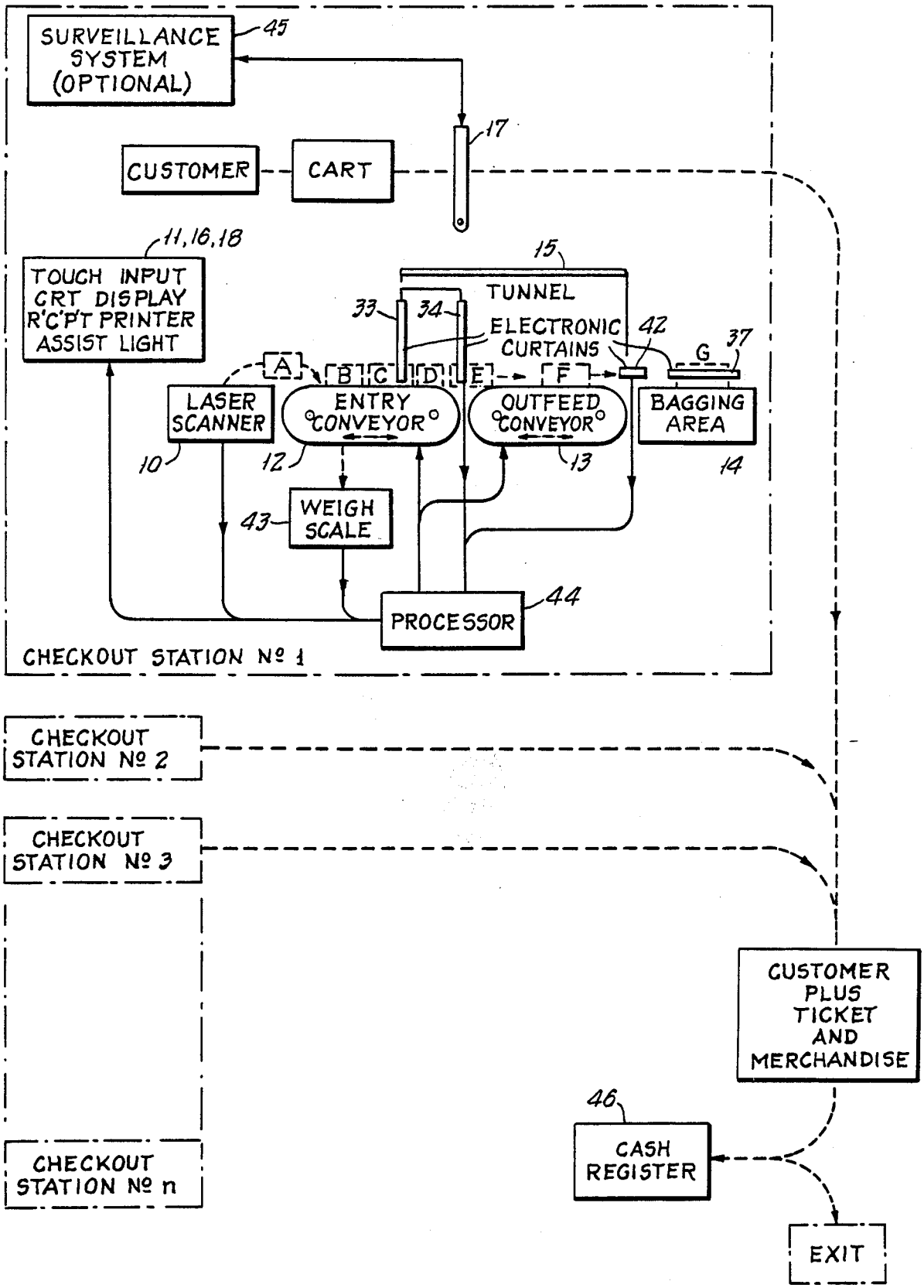
FIG. 4 is a schematic illustration of the system components in the form of a combined flow chart and block diagram of the embodiment of FIG. 1.

Referring to FIGS. 1, 2 and 4, each counter 20 has an electronic curtain at the entry to its tunnel 15. The curtain is established by an array 31 of LED elements or other light sources mounted along one side of the tunnel 15 and cooperating with a complemental array 32 of photosensitive diodes or the like mounted along the opposite side of the tunnel 15. For convenience, this electronic curtain is designated generally by the reference numeral 33.

A second electronic curtain, 34, consisting of an LED array 35 and a photosensitive diode array 36 is located at the junction between the entry conveyor 12 and the outfeed conveyor 13, mounted within the tunnel 15 similar to the curtain 33.

While curtains 33 and 34 are vertically oriented within the tunnel 15, a further curtain, 37, is horizontally disposed within the bagging area 14 with the LED array 38 located on one side and the photosensitive diode array 39 located on the opposite side. This is best seen in FIGS. 1 and 4. Finally, a photo beam assembly consisting of a light source 40 and a photosensitive detector 41 provides a detecting beam 42 located at the intersection between the outfeed conveyor 13 and the bagging area 14.

Referring to FIG. 4, the various components of the system of FIG. 1 are shown schematically. Under each entry conveyor 12 there is provided a sensitive weigh scale 43 that responds to any change in the weight of the conveyor that is caused by articles being placed thereon or removed therefrom. The weigh scale 43 can be of conventional construction capable of producing an analog electric output signal which is fed to a processor 44 which processor is tied in over a suitable circuit (not shown) to a central computer for the market which will contain in its memory the entire store inventory by product identification, weight and price. Another link (not shown) couples the processor 44 to the cashier's master monitor 22 and keyboard 23 for furnishing thereto the subtotal information previously mentioned. The central computer for the market can be similar to those now in use in connection with current check-out clerk-cashier operated laser-cash register-scale assemblies.

As further illustrated in FIG. 4, the laser 10 is connected electrically to the processor 44 which is connected to and controls the conveyors 12 and 13, both of which are arranged for both forward and reverse operation. Similarly, each of the electronic screens or beam sensors 33, 34, 37 and 42 is connected to processor 44. An optional surveillance system 45 is connected to the gate 17 through which the customer passes en route to the cash register 46 and then the exit. The cash register 46 includes the components 23 to 26 as shown in FIG. 3.

The surveillance system 45, if used, can be constructed as disclosed in Humble et al. U.S. Pat. No. 4,394,645 for "Electrical Surveillance Apparatus with Moveable Antenna Elements" issued July 19, 1983 and assigned to the same assignee as the present application. As described in said Humble et al. patent suitable antenna coils are concealed within the swinging gates, here the gates 17, and respond to magnetically permeable tags affixed to the various articles. The system is not responsive to tags passed around the gates through the tunnels 15, but will sound an alarm or activate an indicator if any article bearing such tag is carried through the gates either in the shopping cart or on the person of the customer. Naturally, a suitable sensitive element must be affixed to each article in the market that it is desired to maintain under surveillance.

If for some reason as a customer is scanning items with the laser and depositing them on the conveyor 12 a faulty reading is obtained or the apparatus through its weigh scale detects a discrepancy, the conveyor 12 will stop operating and the messages shown in FIG. 10 will appear on display screen 11. The customer will either comply with the instructions or, if assistance is required, will touch location 47 on the screen to illuminate the signal lamp 18 for alerting an appropriate assistant.

The laser 10 has associated with its operation a pair of signal lights 48 and 49, one of which, for example 48, may be green while the other, 49, is red. As mentioned above, when the customer approaches an available counter 20, he or she is greeted with the messages of FIG. 7 on the display screen 11. After touching location 27 on the screen, the customer will begin scanning articles over the laser 10. If the scan is accomplished properly, that is, if the laser has performed a reading of the UPC label, the green light 48 is illuminated to advise the customer that the article may be placed on conveyor 12. If there is some fault in the scan, the red light 49 will be illuminated. Of course, the signal lights 48 and 49 on the counter could be replaced by appropriate signals on the display screen 11 or associated therewith.

Upon a satisfactory scan of an article, the description thereof and its price is displayed on the screen 11 in the format of FIG. 8. At the same time the processor 44 receives information from the central computer (not shown) concerning the normal weight of the article just scanned. This weight is compared with that determined by the weigh scale 43 and if there is proper correllation the conveyors 12 and 13 will convey the article to the bagging area 14. If there is a discrepancy the system will return the article to the customer for repeating the scanning operation.

As each item is being scanned and processed the customer's receipt is being printed. Any deviation from the processing routine, intentional or by accident, will cause the system to stop and inform the customer that a mistake has been made and the article should be rescanned. Upon completion of article scanning, the customer touches location 30 on the FIG. 8 display which action causes the subtotal to be printed on the receipt and the receipt to be delivered by unit 16 to the customer. The customer then proceeds to the cashier 21 as previously described, the receipt from unit 16 providing means for use in establishing, along with the final receipt from the cashier, that the customer is entitled to remove the presented articles from the market, i.e., from the distribution area.

Any convenient number of check-out counters 20, alternatively referred to as check-out stations, can be coupled to a single cash register 46 as shown schematically in FIG. 4.

With the embodiment shown in FIGS. 1 and 2, the laser 10 and display screen 11 of a given counter 20 are rendered inactive and unavailable to a succeeding customer so long as the bagging area 14 of that counter is occupied by articles belonging to a preceding customer. This arrangement, therefore, is not capable of making maximum use of the expensive laser units and display screens. However, considerable increase in efficiency is available through use of the modified structure shown in FIGS. 5 and 6. Here, two sets of conveyors, tunnel and bagging area are served by a single laser and display screen. Where identical components appear in FIGS. 5 and 6 as are included in FIGS. 1 and 2, they are designated by the same reference numeral, or, to designate the duplicate, by the reference numeral primed. For convenience, the dual or duplex counter is designated generally by the reference numeral 50. While not specifically illustrated, it should be understood that a separate weigh scale 43 is located under each of the conveyors 12 and 12′ in FIGS. 5 and 6. A single processor 44, however, can service both conveyor lines and the common laser and screen.

Figure 5:
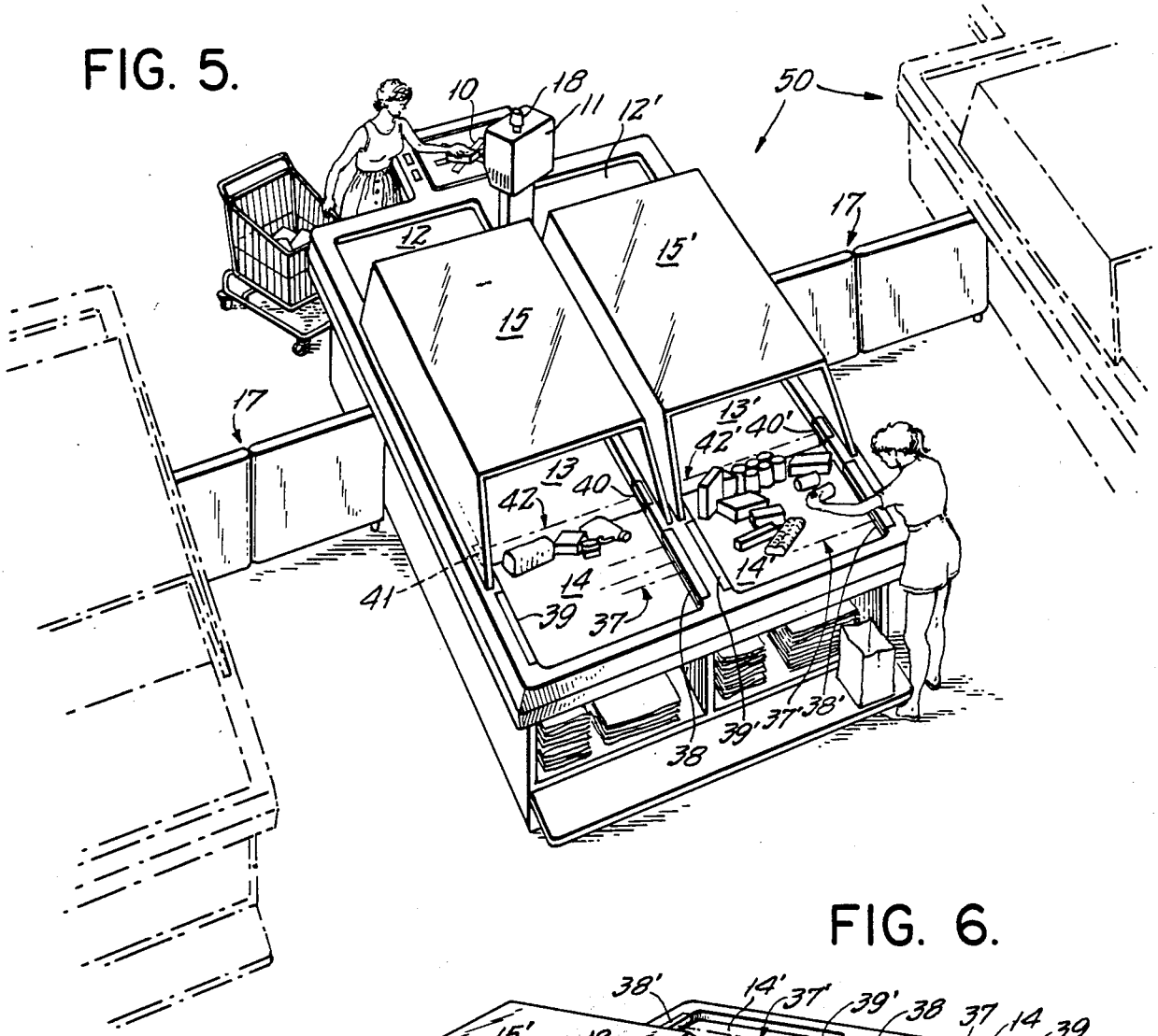
FIG. 5 is a perspective view similar to that of FIG. 1 but showing a modification of the invention wherein dual pathways are associated with a single check-out unit.

As illustrated in FIG. 5, the customers will scan items while standing to one side or the other of the laser 10. For this reason, it may be desirable to duplicate lights 48 and 49 as 48′ and 49′ in the manner best seen in FIG. 6. Also, the display screen 11 is preferably pivotably mounted to permit rotation by the customer so that the screen and customer are directly facing one another.

Figure 6:
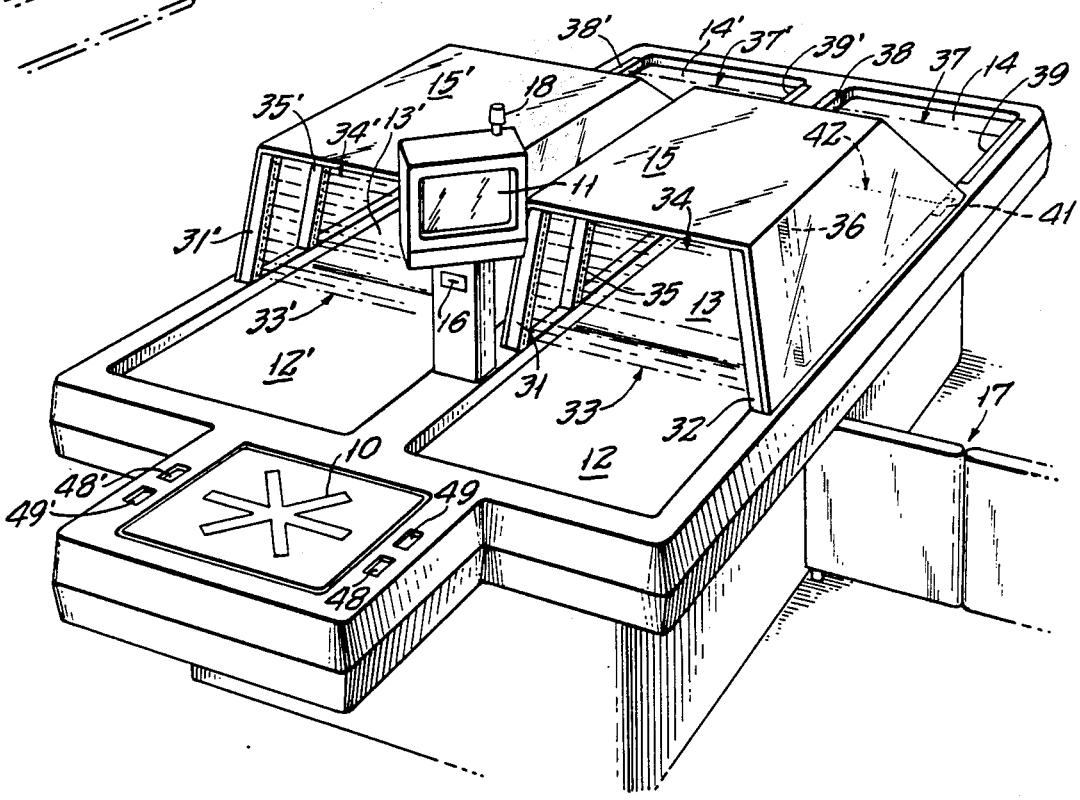
FIG. 6 is a perspective view of one of the counters of the embodiment of FIG. 5 as seen from the entry end thereof.
Figure 11:
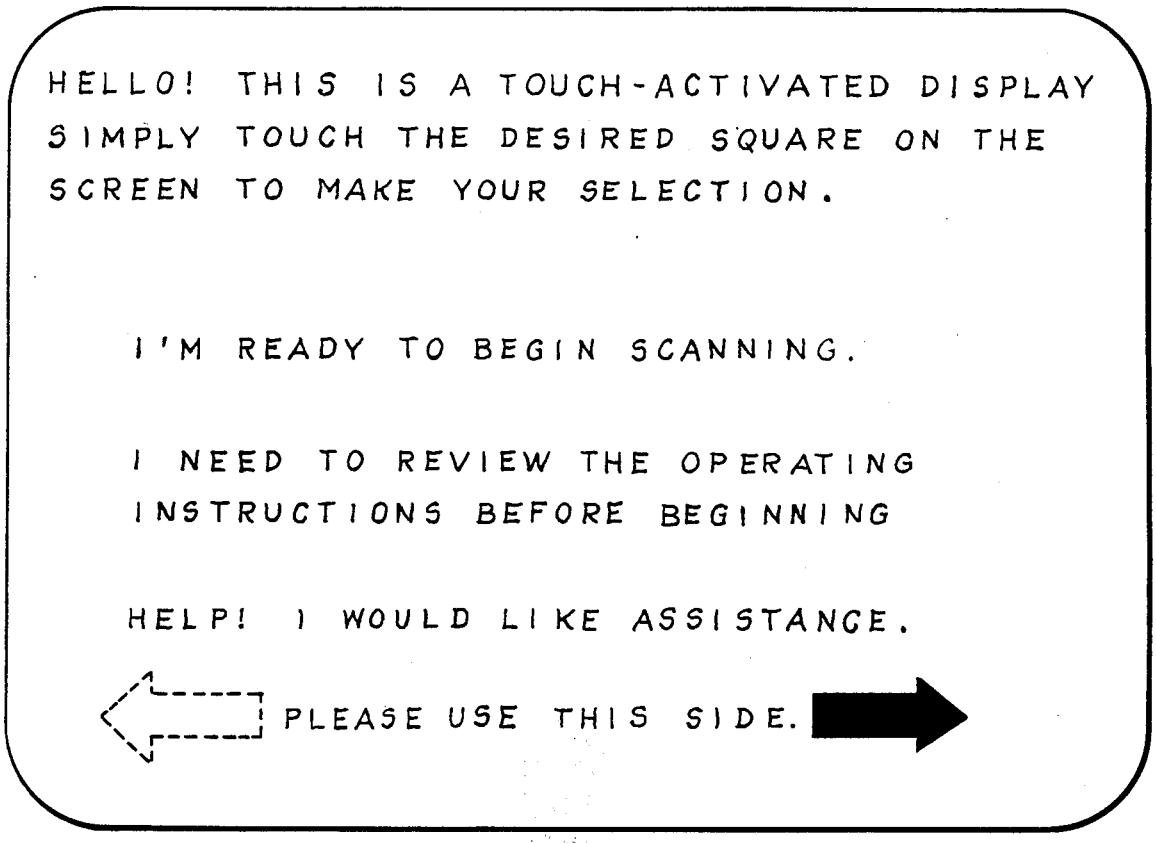
FIG. 11 is a display screen similar to that of FIG. 7 but containing a modification applicable to the embodiment of FIG. 5.

There is one further departure found in the embodiment of FIGS. 5 and 6. Here, as illustrated in FIG. 5, one customer can be bagging articles from, for example, bagging area 14′ while a second customer is using the common laser 10, but feeding articles to the alternate conveyor line consisting of conveyors 12 and 13. In order to direct the customer, an additional message is incorporaed in the initial display for screen 11, which message appears on the last line of FIG. 11. This directive is included only as a convenient curtesy since conveyor 12′ will be kept inoperative and conveyor 12 will start up when the first article is screened if bagging area 14′ is to be protected from commingling by items from a following customer. Of course, when bagging area 14 is occupied the operation is transferred to the conveyor 12′ while conveyor 12 is kept inoperative.

For a more detailed understanding of the operation of the system reference should be had to the "STATUS TABLE" that follows. For the purpose of reading the table, the first curtain is either the curtain 33 or 33′, while the second curtain is either the curtain 34 or 34′. Each state appears on a different line designated by one or two letters of the alphabet. The description of the state is only presented in abbreviated form and will be understood only when read as part of a progression through the states of the apparatus.

Line "A" represents the initial state. Both conveyors 12 and 13 are off or stationary. The scanner 10 is enabled ready to read the UPC label of any item passed thereover. The weigh scale 43 is disabled, and the initial display of FIG. 7 is on the screen 11.

Various actions, either by the apparatus or by the customer, are listed under "INPUT CONDITIONS". Only those in which a letter appears in the corresponding box below the heading are valid inputs for the states on that line. Thus, for the initial state either a scan can occur or an illegal break or interruption in curtain 33 can take place. Such a curtain break might occur if the customer tried to place something downstream on the conveyors without scanning the UPC label. Hence, on line "A" under "First Curtain Break" appears the letter "C" indicating a change to the state on line "C" which state is identified as "Illegal Operation".

STATE TABLE

| RESULTANT STATE | INPUT CONDITIONS | | | | | | | | | |
|---|---|---|---|---|---|---|---|---|---|---|
| | | First Curtain | | Second Curtain | | Weight | | | | |
| | Scan | Break | Restore | Break | Restore | Valid | Invalid | Excess Time | Touch Input | Item Printed |
| A. INITIAL STATE . . . Conveyors off, scanner enabled, scale disabled, display "HELLO!" (FIG. 7) | B | C | | | | | | | | |
| B. 1 ITEM SCANNED . . . Conveyors fwd., scanner disabled, scale enabled, set 5 sec. time | | D | | | | E | C | C | | |
| C. ILLEGAL OPERATION . . . Entry rev., outfeed no change, scanner disabled, scale disabled, remove item, set 5 sec. time, display "REMOVE" (FIG. 10) | | | FF | | | | | F | | |
| D. 1 ITEM, BREAK 1st CURTAIN, NO WEIGHT . . . Entry fwd., outfeed fwd., scanner disabled, scale enabled | | | I | C | | H | C | | | |
| E. 1 ITEM, WEIGHT VALID . . . Entry fwd., outfeed fwd., scanner enabled, scale enabled | J | H | | | | | C | | | |
| F. ASSUME ITEM REMOVED . . . Entry stop, outfeed fwd., scanner enabled, scale disabled, set 5 sec. time, display "REMOVE" (FIG. 10) | B | C | | | | | | IF ITEM PRINTED THEN G, ELSE A | | |
| G. COMPLETION QUERY . . . Entry stop, outfeed fwd., scanner enabled, scale disabled, display "FINISHED?" (FIG. 8) | B | C | | | | | | | EE | |
| H. 1 ITEM, IN 1st CURTAIN, WEIGHT VALID . . . Entry fwd., outfeed fwd., scanner enabled, scale enabled | K | | L | JJ | | | C | | | |
| I. 1 ITEM, BEYOND 1st CURTAIN, NO WEIGHT . . . Entry fwd., outfeed fwd., scanner disabled, scale enabled | | C | | C | | L | C | | | |
| J. 2 ITEMS, BEFORE 1st CURTAIN, NO WEIGHT . . . Entry fwd., outfeed fwd., scanner disabled, scale enabled | | K | | GG | | M | C | | | |
| K. 2 ITEMS, 1 IN 1st CURTAIN, NO WEIGHT . . . Entry fwd., outfeed fwd., scanner disabled, scale enabled | | | N | C | | O | C | | | |
| L. 1 ITEM, BEYOND 1st CURTAIN, WEIGHT VALID . . . Entry fwd., outfeed fwd., scanner enabled, scale enabled | N | C | | P | | | C | | | |
| M. 2 ITEMS, BEFORE 1st CURTAIN, WEIGHT VALID . . . Entry fwd., outfeed fwd., scanner disabled, scale enabled | | O | | | | | C | | | |
| N. 2 ITEMS, 1 BEYOND 1st CURTAIN, NO WEIGHT . . . Entry fwd., outfeed fwd., scanner disabled, scale enabled | | Q | | GG | | R | C | | | |
| O. 2 ITEMS, 1 IN 1st CURTAIN, WEIGHT VALID . . . Entry fwd., outfeed fwd., scanner disabled, scale enabled | | | R | KK | | | C | | | |
| P. 1 ITEM, WEIGHT VALID, IN 2nd CURTAIN . . . Entry fwd., outfeed fwd., scanner | | S | | | DD | | S | | | |

STATE TABLE -continued

| RESULTANT STATE | INPUT CONDITIONS | | | | | | | | | |
|---|---|---|---|---|---|---|---|---|---|---|
| | | First Curtain | | Second Curtain | | Weight | | | | |
| | Scan | Break | Restore | Break | Restore | Valid | Invalid | Excess Time | Touch Input | Item Printed |
| disabled, scale disabled | | | | | | | | | | |
| Q. 2 ITEMS, 1 IN AND 1 BEYOND 1st CURTAIN, NO WEIGHT . . . Entry fwd., outfeed fwd., scanner disabled, scale enabled | | | T | C | | U | C | | | |
| R. 2 ITEMS, 1 BEFORE AND 1 BEYOND 1st CURTAIN, WEIGHT VALID . . . Entry fwd., outfeed fwd., scanner disabled, scale enabed | | U | | V | | | C | | | |
| S. PASS ITEM IN 2nd CURTAIN, WEIGHT INVALID OR 1st CURTAIN BROKEN . . . Entry fwd., outfeed fwd., scanner disabled, scale disabled | | | | | W | | | | | |
| T. 2 ITEMS, BOTH BEYOND 1st CURTAIN, NO WEIGHT . . . Entry fwd., outfeed fwd., scanner disabled, scale enabled | | C | | C | | X | C | | | |
| U. 2 ITEMS, 1 IN AND 1 BEYOND 1st Curtain, WEIGHT VALID . . . Entry fwd., outfeed fwd., scanner disabled, scale enabled | | | X | Y | | | C | | | |
| V. 2 ITEMS, 1 BEFORE 1st and 1 IN 2nd CURTAIN, WEIGHT VALID . . . Entry fwd., outfeed fwd., scanner disabled, scale enabled | | Y | | | Z | | S | | | |
| W. 1 ITEM BEYOND 2nd CURTAIN, WEIGHT INVALID OR 1st CURTAIN BROKEN . . . Entry fwd., outfeed fwd., scanner disabled, scale disabled, print item | | | | | | | | | | C |
| X. 2 ITEMS, BOTH BEYOND 1st CURTAIN, WEIGHT VALID . . . Entry fwd., outfeed fwd., scanner disabled, scale enabled | | C | | AA | | | C | | | |
| Y. 2 ITEMS, 1 IN EACH CURTAIN, WEIGHT VALID . . . Entry fwd., outfeed fwd., scanner disabled, scale enabled | | | AA | | BB | | S | | | |
| Z. 1 ITEM BEYOND 2nd AND 1 ITEM BEFORE 1st CURTAIN, NO WEIGHT . . . Entry fwd., outfeed fwd., scanner disabled, scale enabled, print item | | | | | | | | | | B |
| AA. 2 ITEMS, 1 BEYOND 1st and 1 IN 2nd CURTAIN, WEIGHT VALID . . . Entry fwd., outfeed fwd., scanner disabled, scale enabled | | S | | | CC | | S | | | |
| BB. 1 ITEM IN 1st AND 1 ITEM BEYOND 2nd CURTAIN, NO WEIGHT . . . Entry fwd., outfeed fwd., scanner disabled, scale | | | | | | | | | | D |

STATE TABLE -continued

| | | INPUT CONDITIONS | | | | | | | | | |
|---|---|---|---|---|---|---|---|---|---|---|---|
| | | | First Curtain | | Second Curtain | | Weight | | | | |
| | RESULTANT STATE | Scan | Break | Restore | Break | Restore | Valid | Invalid | Excess Time | Touch Input | Item Printed |
| | enabled, print item | | | | | | | | | | |
| CC. | 1 ITEM BEYOND EACH CURTAIN, NO WEIGHT . . . Entry fwd., outfeed fwd., scanner disabled, scale enabled, print item | | | | | | | | | | I |
| DD. | 1 ITEM BEYOND 2nd CURTAIN . . . Entry stop, outfeed fwd., scanner enabled, scale disabled, print item, set 5 sec. time | B | C | | | | | | G | | |
| EE. | THANK YOU . . . Entry stop, outfeed fwd., scanner disabled, scale disabled, print subtotal, set 15 sec. time, display "THANK YOU" (FIG. 9) | | C | | | | | | A | | |
| FF. | 1st CURTAIN RESTORED AFTER ILLEGAL 1st CURTAIN BREAK . . . Entry rev., outfeed no change, scanner disabled, scale disabled, set 3 sec. time, display "REMOVE" (FIG. 10) | | C | | GG | | | | IF ITEM PRINTED THEN G, ELSE A | | |
| GG. | ILLEGAL 2nd CURTAIN BREAK . . . Entry rev., outfeed rev., scanner disabled, scale disabled, display "REMOVE" (FIG. 10) | | | | | HH | | | | | |
| HH. | 2nd CURTAIN RESTORED AFTER ILLEGAL BREAK . . . Entry rev., outfeed rev., scanner disabled, scale disabled, set 2 sec. time, remove items, display "REMOVE" (FIG. 10) | | C | | II | | | | IF ITEM PRINTED THEN G, ELSE A | | |
| II. | SUCCESSIVE 2nd CURTAIN BREAK . . . Entry rev., outfeed rev., scanner disabled, scale disabled, display "REMOVE" (FIG. 10) | | | | | FF | | | | | |
| JJ. | 1 ITEM, BOTH CURTAINS BROKEN, WEIGHT VALID . . . Entry fwd., outfeed fwd., scanner disabled, scale enabled | | | P | | HH | | C | | | |
| KK. | 2 ITEMS, BOTH CURTAINS BROKEN, WEIGHT VALID . . . Entry fwd., outfeed fwd., scanner disabled, scale enabled | | | V | | HH | | C | | | |

Following through an initial illegal operation it will be observed that an illegal operation state is accompanied by reverse operation of the entry conveyor 12. This is abbreviated as "Entry rev." in the state table. Simultaneously, the operation of the outfeed conveyor 13 will remain unchanged. In this situation, since it never commenced operation, it will be stationary. The scanner 10 is disabled, the weigh scale 43 is disabled, and the screen 11 will display the remove item message of FIG. 10. Also the timing of a 5 second time interval will commence. If no action takes place within 5 seconds, the system sequences to the state on line "F" in which conveyor 12 is halted, signified by "Entry stop", conveyor 13 operates in the forward direction ("outfeed fwd."), the scanner 10 is enabled while the scale 43 is disabled, the FIG. 10 display remains on screen 11, and another 5 second interval is timed. If nothing happens within the next 5 seconds, since this was an initial state change before any items had been processed or printed, the system will revert to state "A", the initial state.

Using the principles implicit in the procedure just described, it is possible to track through the state table any sequence of events. For the purpose of further explanation a series of legitimate operations will be considered.

Assume a customer approaches, as before, while the system is in state "A", and scans the first item which is then placed on the conveyor 12. In FIG. 4, this operation is represented by movement of the item through position "A" to position "B" on conveyor 12 in front of curtain 33. The state table indicates, line "B", that 1 item has been scanned, both conveyors are moving forward, the scanner is now disabled but the scale is enabled, and a 5 second interval is set to be timed out. If the weight is not validated or the curtain 33 interrupted within 5 seconds, it is treated as an illegal operation, as mentioned above. But assume movement of the item from position "B" to position "C" on conveyor 12 (see FIG. 4) causing interruption of curtain 33. The system sequences to state "D". The conveyors are moving forward, the scanner is disabled and the scale is enabled. With valid operation the next event should either be movement of the article to position "D" to restore curtain 33 or a determination of a valid weight. If curtain 33 is restored first, the system progresses to state "I" with both conveyors 12 and 13 operating in the forward direction, the scanner disabled and the scale enabled.

Verification of proper weight at this point causes the system to step to state "L". Both conveyors 12 and 13 operate in forward direction, and now the scanner is enabled. When the article reaches position "E" it crosses from conveyor 12 to conveyor 13 and interrupts curtain 34 causing a change to state "P". At this juncture the conveyors 12 and 13 are moving forward, and both the laser 10 and scale 43 are disabled.

The next valid operation will be a restoration of curtain 34 when the article has advanced onto conveyor 13 as represented by position "F". As intended with all the position indications, the location of the phantom lined box in FIG. 4 is significant only insofar as it indicates a position before, in or after a given curtain. Now with curtain 34 restored, the sequence advances to state "DD", during which printing on the receipt takes place. This is accompanied by a 5 second interval. If another article is not scanned during this interval, progress shifts to state "G" in which the outfeed conveyor 13 continues forward operation, the conveyor 12 is stationary, the scanner is enabled, the scale disabled, and the screen 11 displays FIG. 8.

Now, touching location 30 (see FIG. 8) signifying that the customer is finished will cause advance to state "EE" during which the screen 11 displays FIG. 9, the subtotal is printed, only the outfeed conveyor 13 continues to operate, and timing of a 15 second interval commences. At the end of this interval the system returns to state "A". However, if the article is too large to clear the conveyor 13 into bagging area 14, or if the bagging area is overcrowded such that photo-optical beam 42 is interrupted, the outfeed conveyor 13 will continue to operate until such time as beam 42 is restored. So long as this condition prevails the processor 44 will prevent operation of laser 10 and conveyor 13, i.e., will delay state "A". Also, as long as curtain 37 is interrupted by one or more articles in bagging area 14, state "A" will be delayed.

One further example will be followed through after which one should be able to follow through any sequence of operation by referring to the state table. Again, commencing with state "A", an article is scanned and moved through position "A" to position "B" on conveyor 12 as seen in FIG. 4. The resultant state is that appearing on line "B". The article will probably advance from position "B" to position "C" breaking curtain 33, and then via state "D" the curtain 33 will be restored with the sequence proceeding to state "I". The scanner is still disabled. By this point in time with the article at position "D", the weight should have been validated resulting in assumption of state "L" wherein the scanner is enabled. Assuming that a second item is scanned before curtain 34 is interrupted, the system shifts to state "N" with two items on the entry conveyor 12, one in the area "B" and the other in the area "D". At this point, depending upon relative positions of the two articles now on the conveyor 12, either the first or second curtain 33 or 34 will be interrupted. If curtain 33 is interrupted, the system progresses to state "Q". Assuming now that the second article proceeds beyond the first curtain to restore curtain 33, the system proceeds to state "T". The assumption here is that the next event will be a revalidation of the weight. Because two items are on conveyor 12, the measured weight must equal the total weight thereof. If a valid weight is confirmed, at state "T", the next state will be "X" whereupon the first item must break curtain 34, shifting to state "AA", followed by restoration of curtain 34 with the first item entering conveyor 13. Now the system will be at state "CC". At this point, the data regarding the item that has just passed through curtain 34 will be printed and the system will shift to state "I". Here, the second item requires validation of its weight which will cause the system to shift to state "L". If no further items are scanned and the item now at position "D" on the conveyor passes to position "E", the curtain 34 will be interrupted and the system will shift to state "P". Next, curtain 34 will be restored shifting the system to state "DD" where, if no further scanning takes place, after an elapse of 5 seconds the system will shift to state "G" where the screen 11 will display the completion query of FIG. 8. Upon the customer touching location 30 on the screen as shown in FIG. 8, the system will shift to state "EE" during which the final display of FIG. 9 will appear on screen 11. When the preset 15 second time interval has elapsed, the system will now revert to the initial state of line "A" awaiting a new customer.

Referring to the operating sequence just described, it is significant that at state "T" a valid weight is required to avoid assumption by the system of an illegal operation. That is, if the sequence is recalled, the weight of the first item was validated initially at state "D". Nevertheless, when a second item is placed on conveyor 12 before the first item has exited, the system requires that the weights be revalidated. Then it requires the first item to exit whereupon the weight of the second item is confirmed independently. This operation is designed to prevent fraudulent use of the system. For example, if the first item is at position "D" when the second item is legitimately at position "C" causing a break in curtain 33, the apparatus could not detect if the customer simultaneously passed a hand through curtain 33 and placed a third item on conveyor 12 at place "D" alongside the first item, unless the weight is now re-checked. Therefore, each time curtain 33 is interrupted, the weight must be revalidated before an item can pass curtain 34.

Another interesting condition involves the handling of long items. Such items would interrupt curtain 33 and arrive at curtain 34 causing interruption thereof before curtain 33 is restored. This must be treated as valid assuming that the weight was validated before interruption of curtain 34. An example, might follow the state sequence "A", "B", "D", "H", "JJ". At this point, curtain 33 must be restored prior to curtain 34. Therefore, a valid continuation of states would be "P", "DD", followed by either "B" or "G", etc.

While the system of the present invention has been described with reference to the check-out counters of a supermarket, it should be apparent to those skilled in the art that the system can be applied to any distribution system wherein articles bearing individual media that contain identification data are to be maintained under control.

Having described the invention with reference to the presently preferred embodiments, it should be understood that numerous changes in construction may be introduced without departing from the true spirit of the invention as defined in the appended claims.

What is claimed is:

1. A system for processing an article selected for purchase comprising:

(a) conveyor means for receipt and transport of such article;

(b) means providing a security zone extending along at least a portion of said conveyor means;

(c) sensing means at an inlet to said security zone, said sensing means comprising a first article characteristic sensing means and a second article prescence sensing means, said first sensing means being positioned upstream of said second article sensing means with respect to the conveyor means, said sensing means generating output signals, each indicative of an entry through said inlet into said security zone; and (d) control means for selective movement of said conveyor means in article acceptance and article rejection senses, said control means being operable for continuance of movement of said conveyor means in article acceptance sense upon occurrence of a first sensing means output signal and for moving said conveyor means in article rejection sense in response to occurrence of another of said first sensing means output signals.

2. A system for processing an article selected for purchase and bearing an identification code, said system comprising:

(a) code reader means for generating an output signal indicative of such article identification code;

(b) conveyor means for receipt and transport of such article;

(c) means providing a security zone extending along at least a portion of said conveyor means;

(d) first sensing means for generating an output signal indicative of a measurable characteristic of said article;

(e) second sensing means located at a location within said security zone for generating an output signal indicative of the conveyance of such article to said location; and (f) control means for selective movement of said conveyor means in respective article acceptance and article rejection senses, said control means being operable I. for storage, for each of a plurality of such articles, of a signal indicative of such measurable characteristic thereof correlated with such article identification code;

II. for response to said code reader means output signal for comparison of such stored signal with said output signal of said first sensing means;

III. for operation of said conveyor means in article rejection sense in response to failure of such comparison and also in response to occurrence of said second sensing means output signal generated without preceding occurrence of said comparison; and IV. for continance of movement of said conveyor means in article acceptance sense upon occurrence of said second sensing means output signal generated after occurrence of said comparison.

3. The system claimed in claim 2 further including third sensing means for generating an output signal indicative of entry of said article into said security zone and wherein said control means is further operable for moving said conveyor means in article rejection sense where, for a given article, said third sensing means output signal occurs without prior occurrence of said code reader means output signal.

4. A system for processing an article selected for purchase and bearing an identification code, said system comprising:

(a) code reader means for generating an output signal indicative of such article identification code;

(b) conveyor means for receipt and transport of such article to a security zone;

(c) sensing means for generating an output signal indicative of a measurable characteristic of said article; and (d) control means for selective movement of said conveyor means in respective article acceptance and article rejection senses, said control means being operable I. for storage, for each of a plurality of such articles, of a signal indicative of such measurable characteristic thereof correlated with such article identification code;

II. for response to said code reader means output signal for comparison of such stored signal with said output signal of said sensing means;

III. for response to said code reader means output signal to establish a predetermined time period successive to said code reader means output signal; and IV. for operation of said conveyor means in article rejection sense in response to failure of such comparison and also in response to the elapse of such time period without occurrence of said comparison.

5. The system claimed in claim 4 including further sensing means at a location within said security zone for generating an output signal indicative of the conveyance of such article to said location, said control means operating said conveyor means in article rejection sense in response to the occurrence of said third sensing means output signal without occurrence of said comparison.

6. The system claimed in claim 4 further including an additional sensing means for generating an output signal indicative of an entry of said article into said security zone and wherein said control means is further operable for moving said conveyor means in article rejection sense where, for a given article, said additional sensing means output signal occurs without prior occurrence of said code reader means output signal.

7. The system claimed in claim 6 further including third sensing means at a location within said security zone for generating an output signal indicative of the conveyance of such article to said location, said control means operating said conveyor means in article rejection sense in response to the occurrence of said third sensing means output signal without occurrence of said comparison.

8. A system for processing an article selected for purchase and bearing an identification code, said system comprising:

(a) code reader means for generating an output signal indicative of such article identification code;

(b) conveyor means for receipt and transport of such article to a security zone;

(c) sensing means at an inlet to said security zone for generating an output signal indicative of an entry of said article into said security zone; and (d) control means for selective movement of said conveyor means in responsive article acceptance and article rejection senses, said control means being operable I. for response to said code reader means output signal to establish a predetermined time period successive to said code reader means output signal; and II. for operation of said conveyor means in article rejection sense in response to the elapse of such time period without occurrence of said sensing means output signal.

9. The system claimed in claim 8 including further sensing means at a location within said security zone for generating an output signal indicative of the conveyance of such article to said location.

10. The system claimed in claim 8 wherein said control means is further operable for moving said conveyor means in article rejection sense where, for a given article, said sensing means output signal occurs without prior occurrence of said code reader means output signal.

11. The system claimed in claim 10 further including further sensing means at a location within said security zone for generating an output signal indicative of the conveyance of such article to said location.

12. A system for processing an article selected for purchase and bearing an identification code, said system comprising:

(a) code reader means for generating an output signal indicative of such article identification code;

(b) conveyor means for receipt and transport of such article;

(c) means providing a security zone extending along at least a portion of said conveyor means;

(d) first sensing means at an inlet to said security zone for generating output signals, each indicative of an entry through said inlet into said security zone;

(e) second sensing means for generating an output signal indicative of a measurable characteristic of said article; and (f) control means for selective movement of said conveyor means in respective article acceptance and article rejection senses, said control means being operable I. for storage, for each of a plurality of such articles, of a signal indicative of such measurable characteristic thereof correlated with such article identification code;

II. for response to said code reader means output signal for comparison of such stored signal with said output signal of said second sensing means;

III. for operation of said conveyor means in article rejection sense in response to failure of such comparison; and IV. for continuance of movement of said conveyor means in article acceptance sense upon occurrence of a first sensing means output signal and for moving said conveyor means in article rejection sense in response to occurrence of another of said first sensing means output signals.

13. The system claimed in claim 12 wherein a pedestrian pathway extends aside said conveyor means, said system further including an electromagnetic interrogation arrangement for detecting magnetic field disturbing elements, said elements being affixed to such articles and being detected if said articles are transported along said pathway rather than by said conveyor means.

14. The system claimed in claim 12 wherein a price is to be paid by a customer for said articles, characterized in that said pedestrian pathway comprises means for supervising the movement of customers and articles therethrough, said supervising means comprising means for indicating the amount owed by the customer for said articles that have passed through said security zone, means for correcting said amount for any credit entitlement of said articles by said customer, and means for increasing said amount by the price of articles transported by said individual along said pathway.

15. The system claimed in claim 12 further including display screen means for customer interaction with said system.

16. The system claimed in claim 12 wherein said control means is further operable for moving said conveyor means in article rejection sense where, for a given article, the other first sensing means output signal occurs without prior occurrence of said code reader means output signal.

17. The system claimed in claim 16 wherein said control means establishes a predetermined time period successive to said code reader means output signal and moves said conveyor means in article rejection sense upon the elapse of said time period without occurrence of said comparison or without occurrence of the other first sensing means output signal.

18. The system claimed in 12 wherein said second sensing means comprises a weighing mechanism coupled to said conveyor means for measuring the weight of articles placed thereon, such second sensing means output signal being indicative of such measured weight.

19. The system claimed in claim 18 wherein said control means comprises a storage means for storage, for each of a plurality of such articles, of said signal indicative of such measurable characteristics thereof correlated with such article identification code, and a processing unit, said processing unit being coupled to said code reader means, said weighing mechanism and said storage means, wherein for each of a plurality of such articles, said processing unit being responsive to compare said stored signal and said second sensing means output signal.

20. The system claimed in claim 12 further including third sensing means at a location within said security zone for generating an output signal indicative of the conveyance of such article to said location, said control means operating said conveyor means in article rejection sense in response to the occurrence of said third sensing means output signal without occurrence of said comparison.

21. The system claimed in claim 20 wherein said first sensing means generates one of said output signals indicative of such entry of said article into said security zone and wherein said control means is further operable for moving said conveyor means in article rejection sense where, for a given article, said other of said first sensing means output signals occurs without prior occurrence of said code reader means output signal.

22. The system claimed in claim 12 wherein said control means establishes a predetermined time period successive to said code reader means output signal and moves said conveyor means in article rejection sense upon the elapse of said time period without occurrence of said comparison or without occurrence of the other first sensing means output signal.

23. The system claimed in claim 22 further including third sensing means at a location within said security zone for generating an output signal indicative of the conveyance of such article to said location, said control means operating said conveyor means in article rejection sense in response to occurrence of said third sensing means output signal without occurrence of said comparison.

24. The system claimed in claim 23 wherein said first sensing means generates one of said output signals indicative of such entry of said article into said security zone and wherein said control means is further operable for moving said conveyor means in article rejection sense where, for a given article, said other of said first sensing means output signals occurs without prior occurrence of said code reader means output signal.

25. The system claimed in claim 12 further including an article checkout station therewith, said checkout station having an article bagging area, said conveyor means transporting articles through said security zone to said bagging area.

26. The system claimed in claim 25 wherein first and second such conveyor means are included, each extending to said article bagging area, said control means being further operable to preclude said second conveyor means from transporting articles to said bagging area when said first conveyor means is transporting articles to said bagging area.

27. The system claimed in claim 26 wherein said code reader means comprises a single code reader.

28. The system claimed in claim 12 wherein said conveyor means comprises one conveyor extending through said first sensing means and into said security zone, said second sensing means being adjacent said one conveyor.

29. The system claimed in claim 28 including further sensing means at an exit of said security zone for generating an output signal indicative of the exit of articles therefrom.

30. The system claimed in claim 21 wherein said conveyor means includes a second conveyor extending from a junction with said one conveyor to a location exteriorly of said security zone.

31. The system claimed in claim 30 including further sensing means disposed at said junction between said one conveyor and said second conveyor for generating an output signal indicative of the transport of articles therebetween.

32. The system claimed in claim 31 wherein said control means is further operable for moving said one conveyor in article rejection sense upon occurrence of said further sensing means output signal without occurrence of said comparison.

* * * * *